US006151819A

United States Patent [19]

Gorospe

[11] Patent Number: 6,151,819

[45] Date of Patent: Nov. 28, 2000

[54] PAGE MANIPULATING BOOK SUPPORT

[76] Inventor: Ignacio V. Gorospe, 2813 N. Olive La., Santa Ana, Calif. 92706

[21] Appl. No.: 09/296,326

[22] Filed: Apr. 22, 1999

[51] Int. Cl.[7] ..... G09F 19/02

[52] U.S. Cl. ..... 40/531; 40/352; 40/356

[58] Field of Search ..... 40/531, 532, 470, 40/475, 476, 352, 356, 341; 84/486, 487; 248/442.2, 453

[56] References Cited

U.S. PATENT DOCUMENTS

| | | | |
|---|---|---|---|
| D. 275,402 | 9/1984 | O'Brien . | |
| 979,670 | 12/1910 | Hopkins | 40/356 |
| 1,162,312 | 11/1915 | Snyder | 40/356 |
| 1,381,757 | 6/1921 | Sheean | 40/352 |
| 2,265,924 | 12/1941 | Oerter et al. | 40/352 X |
| 2,526,540 | 10/1950 | Carpenter | 40/531 X |
| 2,755,580 | 7/1956 | Justice | 40/531 |
| 2,897,618 | 8/1959 | Russell | 40/531 |
| 3,019,424 | 1/1962 | Goldwater et al. | 40/352 X |
| 3,053,000 | 9/1962 | Schmitt | 40/531 |
| 3,808,720 | 5/1974 | Smith | 40/531 X |
| 4,043,530 | 8/1977 | May . | |
| 4,121,361 | 10/1978 | D'Arcy | 40/470 |
| 4,432,154 | 2/1984 | D'Arcy | 40/531 |
| 4,470,571 | 9/1984 | Hartman | 248/453 X |
| 4,558,527 | 12/1985 | Schroedel et al. | 40/341 X |
| 4,644,675 | 2/1987 | Berger et al. | 40/531 |
| 4,685,374 | 8/1987 | Goldner | 40/470 X |
| 4,760,661 | 8/1988 | Yoshikoshi et al. | 40/352 X |
| 4,882,969 | 11/1989 | Ricca . | |
| 5,222,316 | 6/1993 | Chiou | 40/352 |
| 5,746,408 | 5/1998 | Theirl et al. | 248/442.2 X |

*Primary Examiner*—Joanne Silbermann

[57] ABSTRACT

A reading item supporting system is provided including a reading item support for supporting a book thereon. Also included is at least one ruler assembly positioned on the reading item support with the book therebetween. The ruler assembly includes a ruler strip adapted to move downwardly an incremental distance upon the actuation.

3 Claims, 7 Drawing Sheets

PAGE MANIPULATING BOOK SUPPORT

BACKGROUND OF THE INVENTION

1. Field of the Invention

The present invention relates to book supporting assemblies and more particularly pertains to a new page manipulating book support for supporting a piece of reading material and further selectively maneuvering the same.

2. Description of the Prior Art

The use of book supporting assemblies is known in the prior art. More specifically, book supporting assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 4,121,361; U.S. Pat. No. 4,882,969; U.S. Pat. No. 4,043,530; U.S. Pat. No. 4,432,154; U.S. Pat. Des. No. 275,402; and U.S. Pat. No. 4,644,675.

In these respects, the page manipulating book support according to the present invention substantially departs from the conventional concepts and designs of the prior art, and in so doing provides an apparatus primarily developed for the purpose of supporting a piece of reading material and further selectively maneuvering the same.

SUMMARY OF THE INVENTION

In view of the foregoing disadvantages inherent in the known types of book supporting assemblies now present in the prior art, the present invention provides a new page manipulating book support construction wherein the same can be utilized for supporting a piece of reading material and further selectively maneuvering the same.

The general purpose of the present invention, which will be described subsequently in greater detail, is to provide a new page manipulating book support apparatus and method which has many of the advantages of the book supporting assemblies mentioned heretofore and many novel features that result in a new page manipulating book support which is not anticipated, rendered obvious, suggested, or even implied by any of the prior art book supporting assemblies, either alone or in any combination thereof.

To attain this, the present invention generally comprises a base with a planar rectangular configuration. As shown in FIGS. 1, 3 & 4, a book support is provided including a rear plate with a planar rectangular configuration. A pair of downwardly extending stanchions are coupled to a bottom edge of the rear plate for mounting on the base. A pair of side faces are coupled to side edges of the rear plate and extend forwardly therefrom. A pair of vertically oriented cut outs are formed in the rear plate with a plurality of laterally extending recesses. Coupled within each of the cut outs is a rod that remains in coplanar relationship therewith. A supporting disk has a central aperture for slidably receiving one of the rods. Further, a pair of diametrically opposed grooves are formed in the supporting disk for being selectively positioned level with one of the laterally extending recesses for reasons that will soon become apparent. The book support further includes a pair of rear braces each having a top end coupled to the rear plate and extending downwardly therefrom. Such rear braces terminate with a pair of planar horizontally oriented feet. As shown in FIG. 3, a pair of inverted L-shaped pivot couples are mounted on each of the side faces. Further, a pair of wings each include a hollow inboard planar member having an inboard edge with a pair of tubes. These tubes are pivotally coupled to the L-shaped pivot couples of one of the side faces of the book support. An outboard planar member is slidably positioned within the inboard planar member and has a planar lip extending from a bottom edge thereof. Next provided is a lamp assembly including an adjustable arm mounted to a casing on the rear plate of the book support. A lamp is mounted to the adjustable arm for illuminating purposes. As shown in FIGS. 13 & 14, a swivel support tab has an inboard end hingably coupled to the bottom edge of the outboard planar member of each of the wings. As best shown in FIG. 8, a pair of page lifters are provided each including a housing mounted to the bottom edge of one of the inboard planar members of the book support. This housing has a slot on a top face thereof. A belt is mounted within the housing between a pulley and a motor. Further, an arm is coupled to the belt and extends upwardly through the slot for sliding therein. Finally, a gripping member is mounted to an in-turned end of the arm. As such, the gripping member is moved within the slot upon actuation. A pair of ruler assemblies each include a belt mounted along an outboard edge of one of the outboard planar members of the book support. Such belt is connected between a motor and a pulley, as shown in FIG. 12. Further, an inboard ruler strip has an inboard end hingably coupled to a tab which is mounted on the belt of the ruler. Slidably mounted to an outboard end of the inboard ruler strip is an outboard ruler strip. In operation, the ruler strips of each ruler assembly are adapted to move downwardly an incremental distance upon the actuation thereof. Finally, a controller is connected to the page lifters and the ruler assemblies via an elongated cord for selectively actuating the same.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new page manipulating book support apparatus and method which has many of the advantages of the book supporting assemblies mentioned heretofore and many novel features that result in a new page manipulating book support which is not anticipated, rendered obvious, suggested, or even implied by any of the prior art book supporting assemblies, either alone or in any combination thereof.

It is another object of the present invention to provide a new page manipulating book support which may be easily and efficiently manufactured and marketed.

It is a further object of the present invention to provide a new page manipulating book support which is of a durable and reliable construction.

An even further object of the present invention is to provide a new page manipulating book support which is susceptible of a low cost of manufacture with regard to both materials and labor, and which accordingly is then susceptible of low prices of sale to the consuming public, thereby making such page manipulating book support economically available to the buying public.

Still yet another object of the present invention is to provide a new page manipulating book support which provides in the apparatuses and methods of the prior art some of the advantages thereof, while simultaneously overcoming some of the disadvantages normally associated therewith.

Still another object of the present invention is to provide a new page manipulating book support for supporting a piece of reading material and further selectively maneuvering the same.

Even still another object of the present invention is to provide a new page manipulating book support that includes a reading item support for supporting a book thereon. Also included is at least one ruler assembly positioned on the reading item support with the book therebetween. The ruler assembly includes a ruler strip adapted to move downwardly an incremental distance upon the actuation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 14:
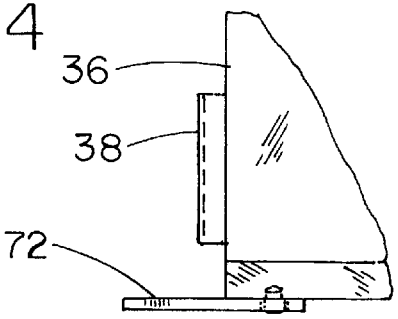
FIGS. 13 and 14 are illustrations of a support arm of the present invention.

With reference now to the drawings, and in particular to FIGS. 1 through 14 thereof, a new page manipulating book support embodying the principles and concepts of the present invention and generally designated by the reference numeral 10 will be described.

Figure 1:
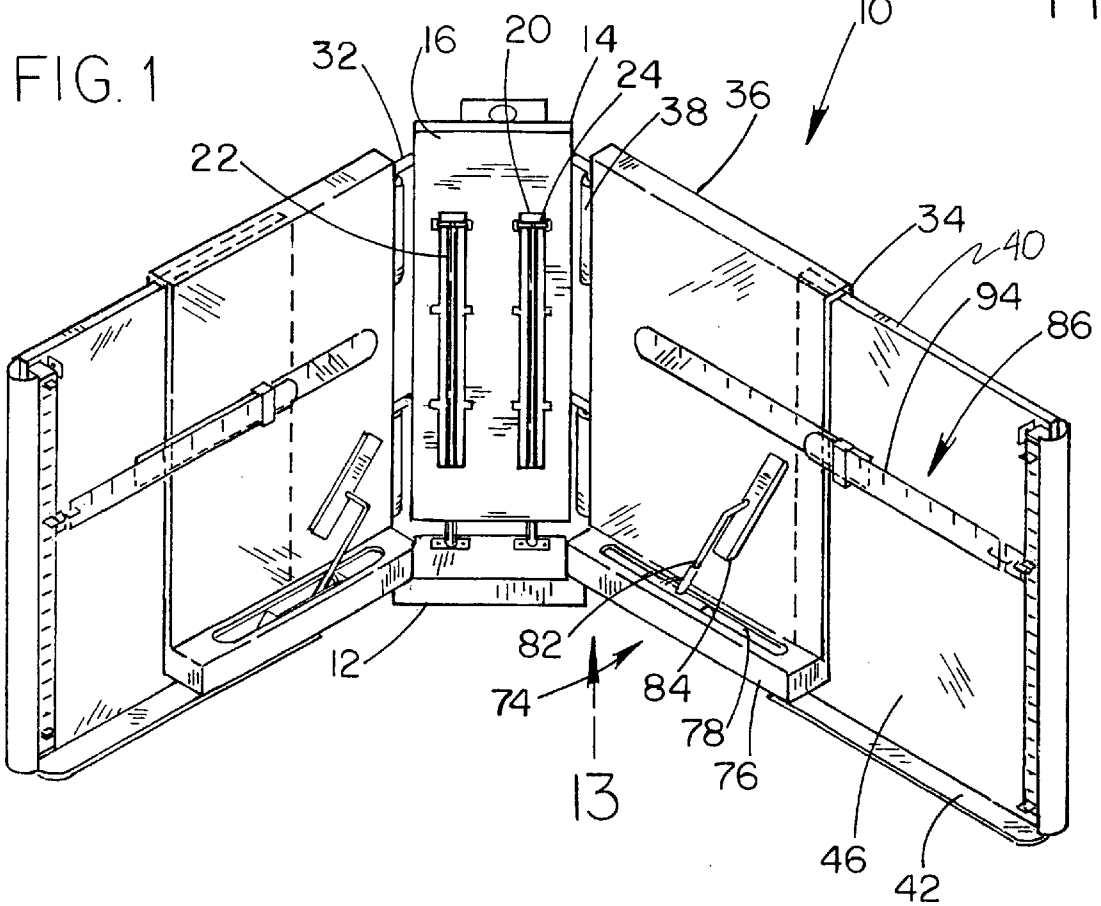
FIG. 1 is a front view of a new page manipulating book support according to the present invention.
Figure 2:
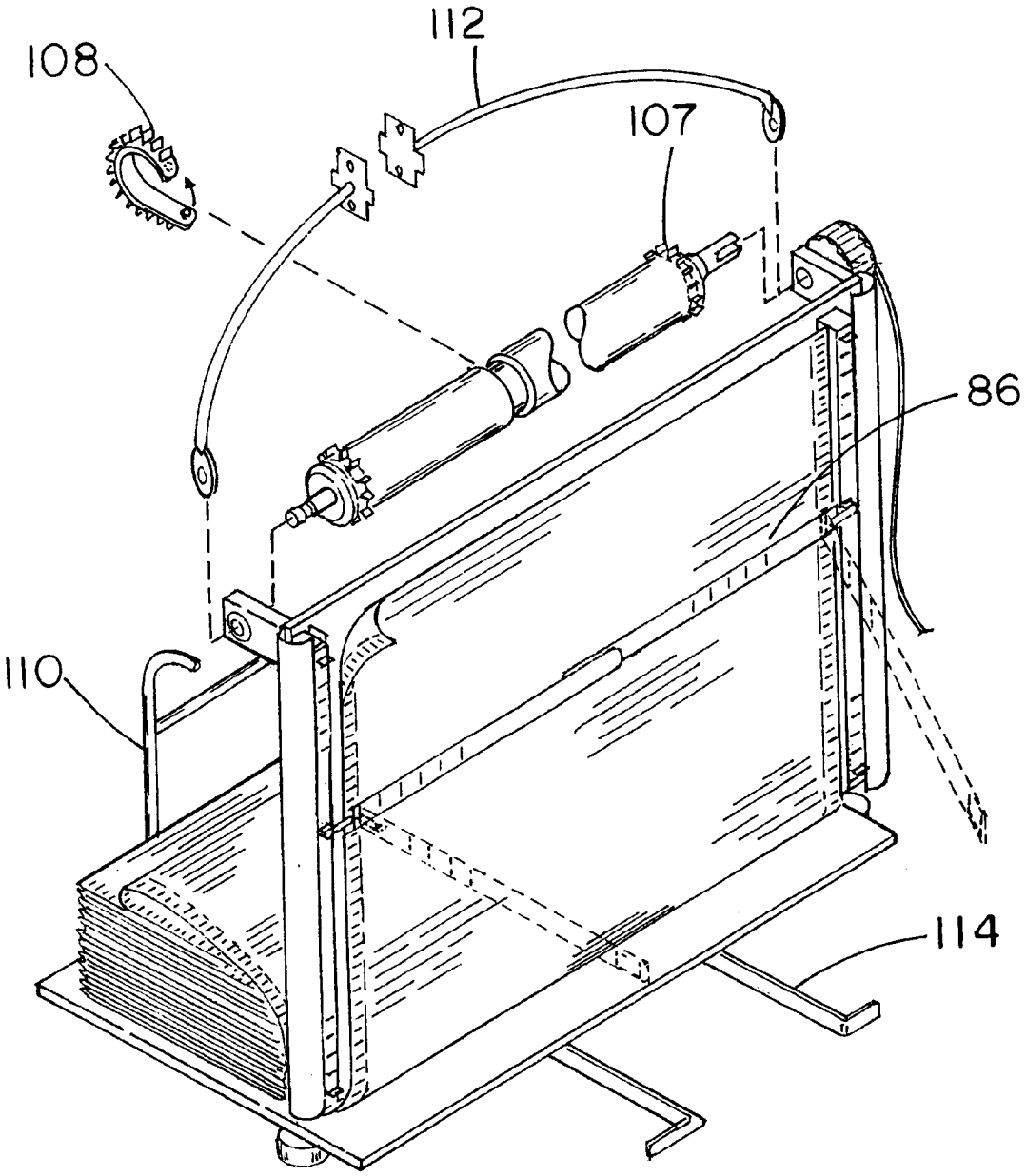
FIG. 2 is a rear perspective view of another embodiment of the present invention.
Figure 3:
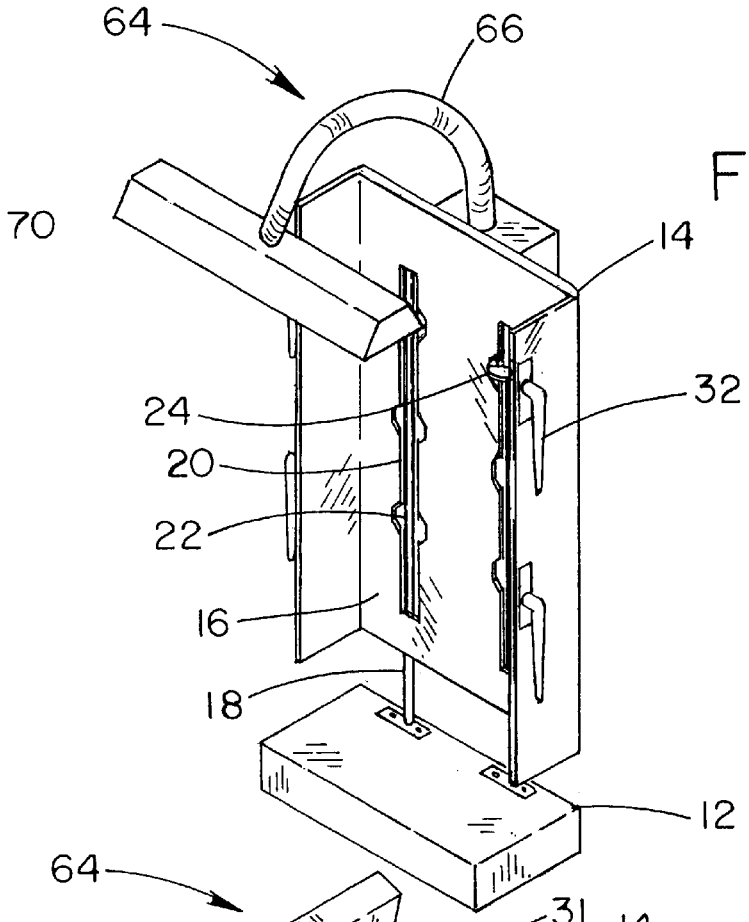
FIG. 3 is a front perspective view of the present invention.
Figure 4:
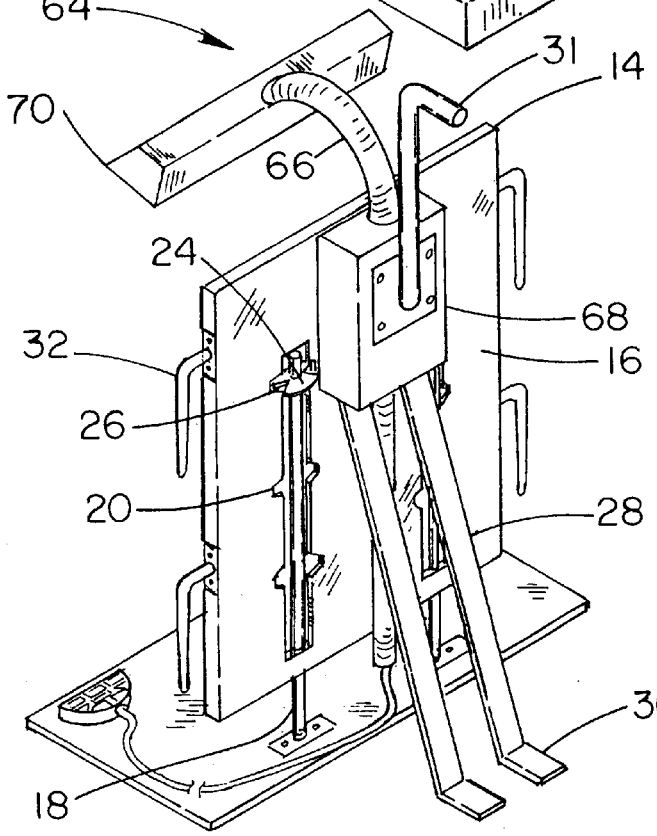
FIG. 4 is a rear perspective view of the present invention.
Figure 5:
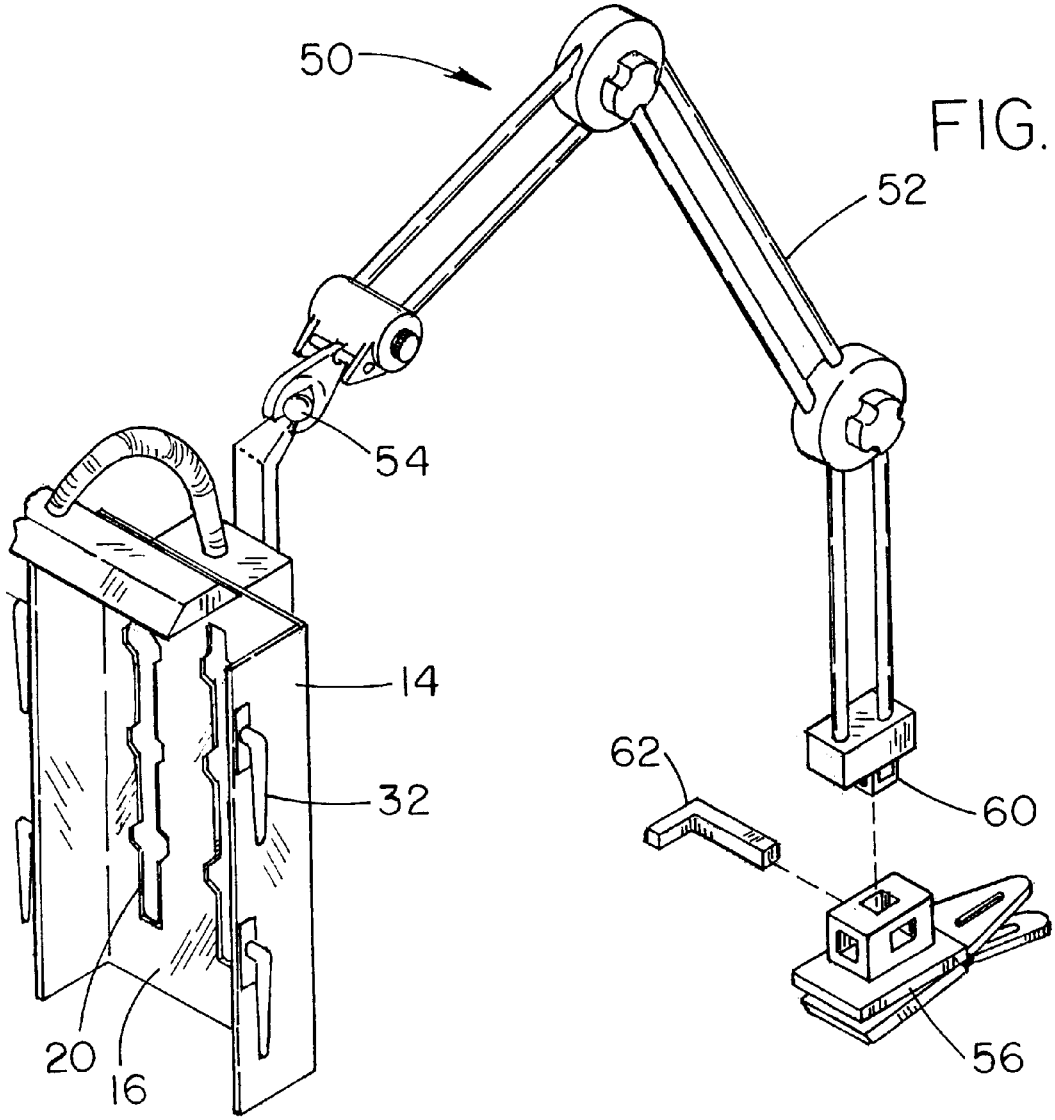
FIG. 5 is a side view of the optional adjustable arm of the present invention.
Figure 6:
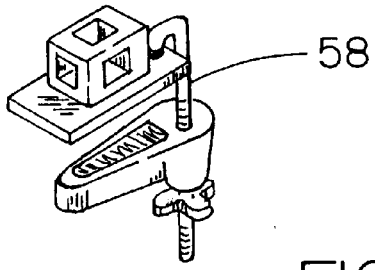
FIG. 6 is a perspective view of an alternate embodiment of the clamp shown in FIG. 5.

The present invention, designated as numeral 10, includes a base 12 with a planar rectangular configuration. As shown in FIGS. 1, 3 & 4, a book support 14 is provided including a rear plate 16 with a planar rectangular configuration. A pair of downwardly extending stanchions 18 are coupled to a bottom edge of the rear plate for mounting on the base. A pair of side faces are coupled to side edges of the rear plate and extend forwardly therefrom. A pair of vertically oriented cut outs 20 are formed in the rear plate with a plurality of laterally extending recesses. Coupled within each of the cut outs is a rod 22 that remains in coplanar relationship therewith. A supporting disk 24 has a central aperture for slidably receiving one of the rods. Further, a pair of diametrically opposed grooves 26 are formed in the supporting disk for being selectively positioned level with one of the laterally extending recesses for reasons that will soon become apparent. In use, each disk may be slid along the rod such that the grooves slidably receive the edges of the cut outs. Thereafter, the supporting disk may be rotated in order offset the grooves with respect to the edges of the cut outs to maintain the same in place level with one of the laterally extending recesses. By this structure, a spine of a book may be selectively elevated with respect to the book support by being rested on the supporting disks.

The book support further includes a pair of rear braces 28 each having a top end coupled to the rear plate and extending downwardly therefrom. Such rear braces terminate with a pair of planar horizontally oriented feet 30. As an option, an inverted L-shaped handle 31 may be attached to a rear face of the book plate, as shown in FIG. 4. As shown in FIG. 3, a pair of inverted L-shaped pivot couples 32 are mounted on each of the side faces. Further, a pair of wings 34 each include a hollow inboard planar member 36 having an inboard edge with a pair of tubes 38. These tubes are pivotally coupled to the L-shaped pivot couples of one of the side faces of the book support. As an option, the tubes may be formed of an elastomeric material for frictionally receiving the L-shaped pivots. An outboard planar member 40 is slidably positioned within the inboard planar member and has a planar lip 42 extending from a bottom edge thereof. It should be noted that slots and grooves may be employed to maintain the inboard planar member in sliding relationship with the outboard planar member.

Figure 8:
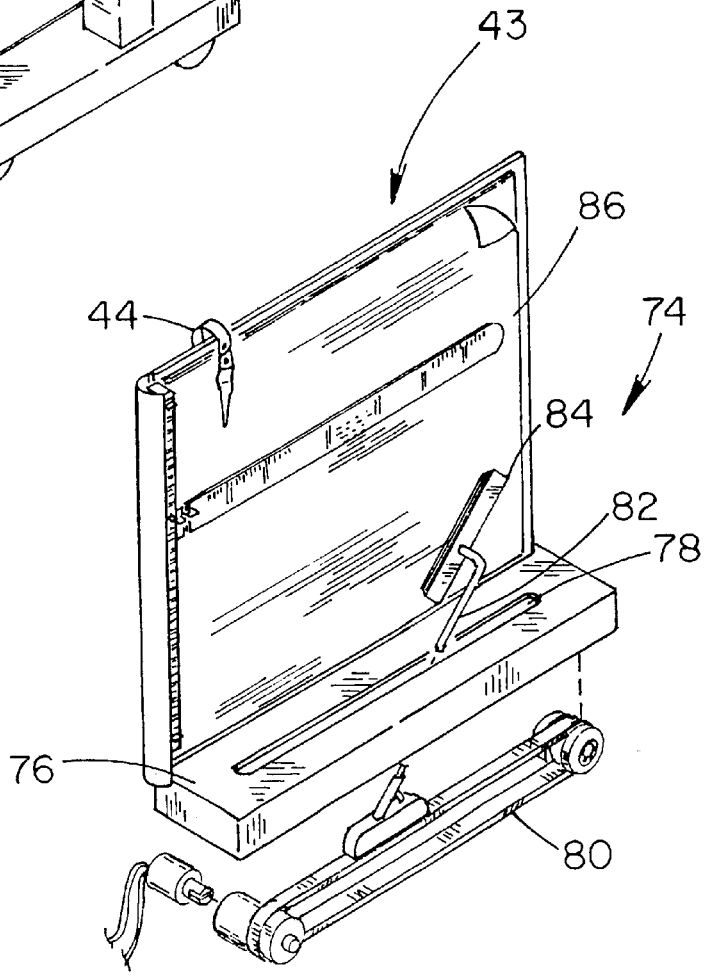
FIG. 8 is a perspective view of an alternate embodiment of the present invention.

In an alternate embodiment 43, each wing may be equipped with merely a single planar member. In yet another embodiment, just the wing may be provided and therefore constitute the book support, as shown in FIG. 8. An optional clip 44 may be positioned on the wing.

In yet another embodiment, an adjustable arm 50 may be employed with a plurality of tightening knobs 52 mounted between each of a plurality of hinged sections. Such adjustable arm is preferably coupled to the rear plate of the book support by means of a ball and socket joint 54. Mounted on an opposite end of the adjustable arm is a spring loaded clamp 56. Note FIG. 5. In the alternative, a clamp like that shown in FIG. 6 may be additionally included which is formed of a threaded bolt 58 mounted between a pair of plates. Both of the clamps are preferably equipped with an apertured coupling box 60 which is adapted to couple with an apertured coupling box mounted on the adjustable arm via an L-shaped pin 62. See FIG. 5.

Figure 7:
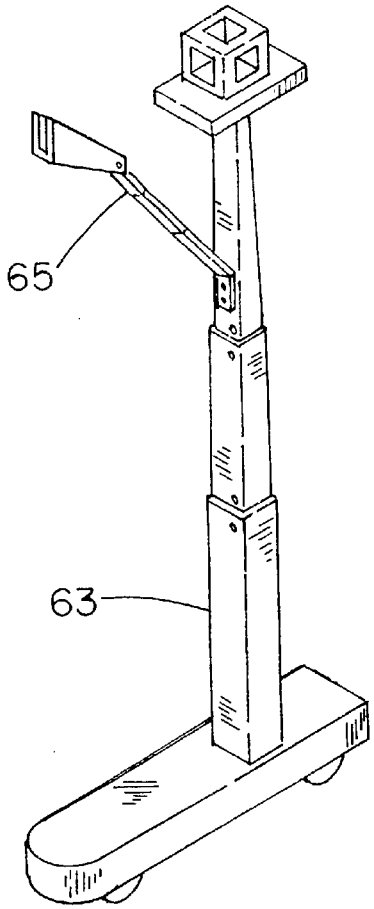
FIG. 7 is a perspective view of an adjustable stand of the present invention.

In lieu of the base set forth hereinabove, any type of supporting structure may be employed. For example, a wheeled telescoping base 63 may be included, as shown in FIG. 7. Such telescoping base preferably has an arm supporter 65 mounted thereon. It should be noted that the wheeled telescoping base is also equipped with a coupling box for attachment of the adjustable arm thereto.

Figure 13:
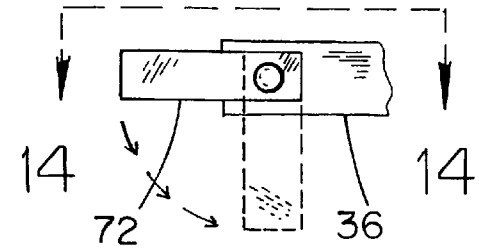

Next provided is a lamp assembly 64 including an adjustable arm 66 mounted to a casing 68 on the rear plate of the book support. A lamp 70 is mounted to the adjustable arm for illuminating purposes. As shown in FIGS. 13 & 14, a swivel support tab 72 has an inboard end hingably coupled to the bottom edge of the outboard planar member of each of the wings. The swivel support preferably works in conjunction with the planar lip in order to support a cover of a book thereon As best shown in FIG. 8, a pair of page lifters 74 are provided each including a housing 76 mounted to the bottom edge of one of the inboard planar members of the book support. This housing has a slot 78 on a top face thereof. A belt 80 is mounted within the housing between a pulley and a motor. Further, an arm 82 is coupled to the belt and extends upwardly through the slot for sliding therein. Finally, a gripping member 84 is mounted to an in-turned end of the arm. As such, the gripping member is moved within the slot upon actuation. In use, the gripping member remains in constant frictional abutment with an outermost page of the book positioned on the book support. It should be noted that movement of the gripping member away from the spine has a null affect on the outermost page while opposing movement lifts the page to facilitate flipping of the page.

Figure 12:
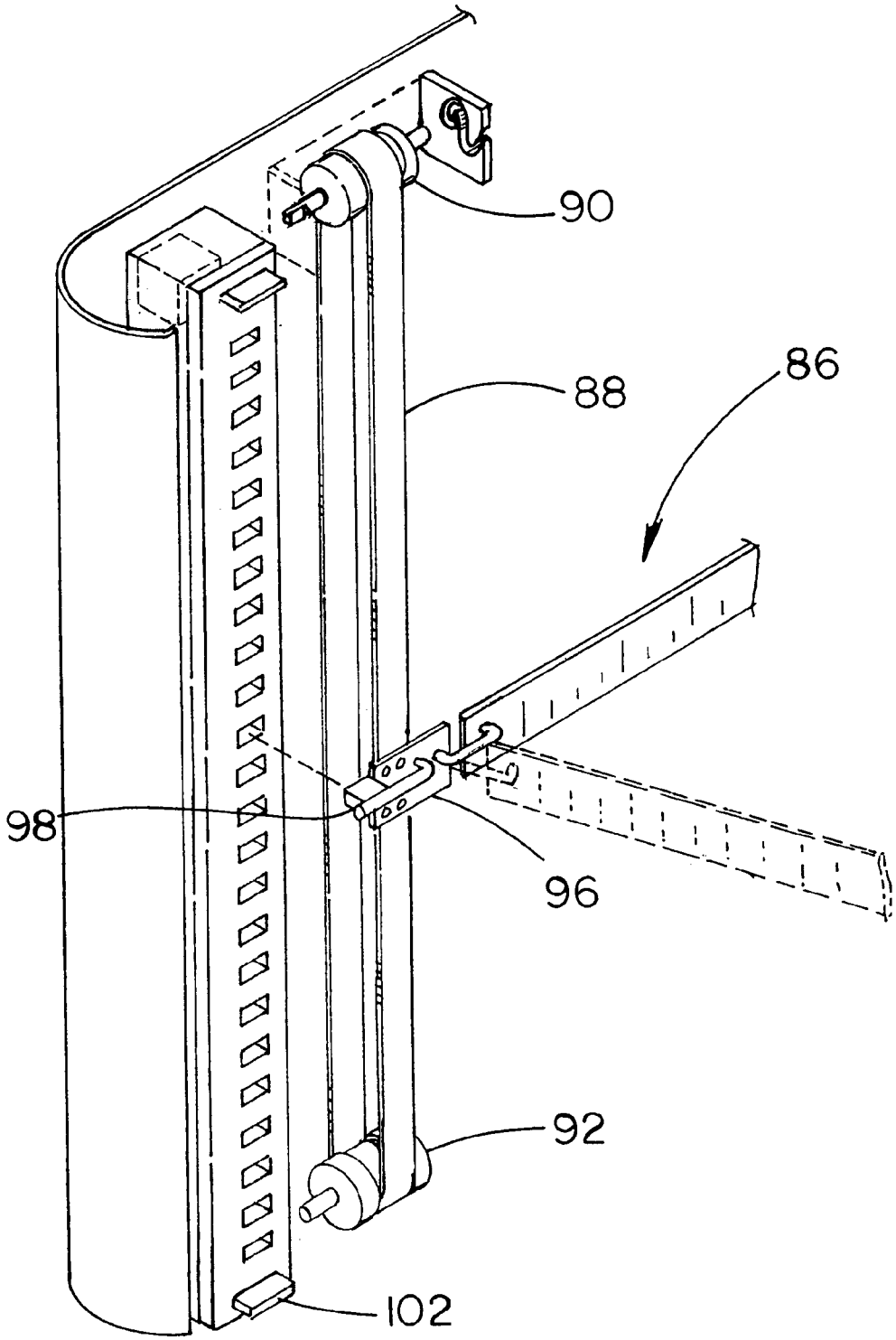
FIG. 12 is a perspective view of the present invention.

A pair of ruler assemblies 86 each include a belt 88 mounted along an outboard edge of one of the outboard planar members of the book support. Such belt is connected between a motor 90 and a pulley 92, as shown in FIG. 12. Further, an inboard ruler strip 94 has an inboard end hingably coupled to a tab 96 which is mounted on the belt of the ruler. Slidably mounted to an outboard end of the inboard ruler strip is an outboard ruler strip. Both strips are preferably constructed from a transparent magnifying material. In operation, the ruler strips of each ruler assembly are adapted to move downwardly an incremental distance upon the actuation thereof. As an option, the aforementioned tab 96 may include a resilient stopper 98 which snappily engages a plurality of holes 100 formed in the outboard edge of the outboard planar member. It should be noted that the stopper snappily engages one of the holes upon each incremental adjustment. Movement of the tab is further constrained by upper and lower extensions 102.

Figure 10:
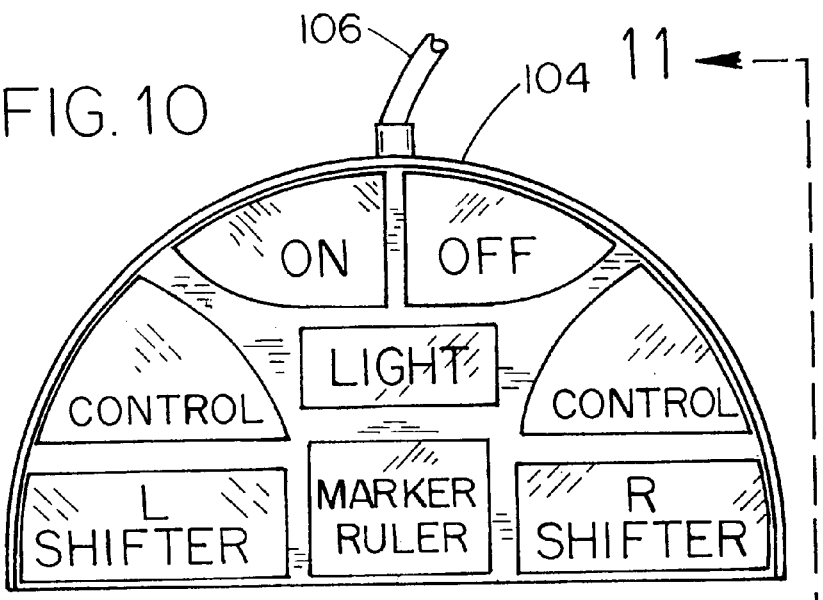
FIG. 10 is a top view of the controller of the present invention.
Figure 11:
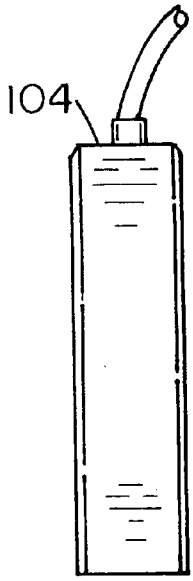
FIG. 11 is a side view of the controller of the present invention.
Figure 9:
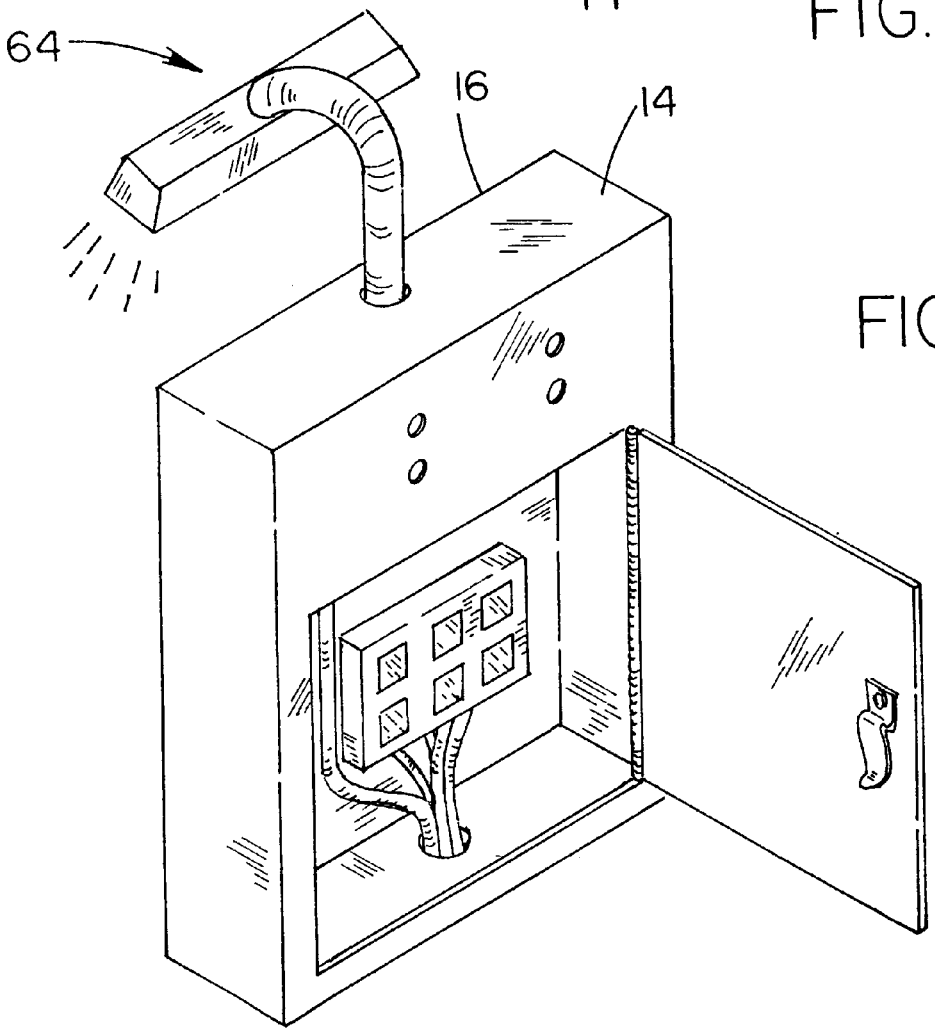
FIG. 9 is a rear perspective view of the book support of the present invention.

Finally, a controller 104 is connected to the motors of the page lifters and the ruler assemblies via an elongated cord 106 for selectively actuating the same. As shown in FIG. 10, the controller has a semi-circular configuration and is portable in nature. Ideally, the controller has a right and left page lifter button for moving the page lifters back and forth one time when depressed. Further, the controller is equipped with a ruler button for actuating the ruler assemblies one time. Associated therewith is a pair of control buttons for automatically moving the associated ruler strip to a topmost position upon depression. It should be noted that this is necessary prior to the depression of the associated lifter button. Lastly, a light button is positioned on the controller for selectively actuating the lamp of the lamp assembly upon the actuation thereof.

In an alternate embodiment, a books support or wing may be adapted to accommodate continuous rolls of computer print out paper. Such embodiment is equipped with a rollers with a plurality of tangs 107 for feeding the paper along a front of the book support beneath the ruler assembly. As an option, removably straps 108 may be positioned on the roller for accommodating various sizes of computer print out paper. A pair of constraint poles 110 are positioned behind the book support for containing the computer print out paper therebehind. The present embodiment may further be equipped with a pair of lamp support bars 112 for supporting a lamp over the book support. Finally, legs 114 may depend from the book support for maintaining the same at an elevated orientation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A book supporting system comprising, in combination:

a base with a planar rectangular configuration;

a book support including a rear plate with a planar rectangular configuration, a pair of downwardly extending stanchions coupled to a bottom edge of the rear plate for mounting on the base, a pair of side faces coupled to side edges of the rear plate and extending forwardly therefrom, a pair of vertically oriented cut outs formed in the rear plate with a plurality of laterally extending recesses, a rod coupled within each of the cut outs in coplanar relationship therewith, a supporting disk having a central aperture for slidably receiving one of the rods and a pair of diametrically opposed grooves for being selectively positioned level with one of the laterally extending recesses, a pair of rear braces each having a top end coupled to the rear plate and extending downwardly therefrom and terminating with a pair of planar horizontally oriented feet, a pair of inverted L-shaped pivot couples mounted on each of the side faces, and a pair of wings each including a hollow inboard planar member having an inboard edge with a pair of tubes pivotally coupled to the L-shaped pivot couples of one of the side faces of the book support, an outboard planar member slidably positioned within the inboard planar member and having a planar lip extending from a bottom edge thereof;

a lamp assembly including an adjustable arm mounted to a casing on the rear plate of the book support and a lamp mounted to the adjustable arm for illuminating purposes;

a pair of page lifters each including a housing mounted to the bottom edge of one of the inboard planar members of the book support and having a slot on a top face thereof, a belt mounted within the housing between a pulley and a motor, an arm coupled to the belt and extending upwardly through the slot for sliding therein, and a gripping member mounted to an in-turned end of the arm, wherein the gripping member is moved within the slot upon actuation;

a swivel support tab having an inboard end hingably coupled to the bottom edge of the outboard planar member of each of the wings;

a pair of ruler assemblies each including a belt mounted along an outboard edge of one of the outboard planar members of the book support and connected between a motor and a pulley, an inboard ruler strip having an inboard end hingably coupled to a tab which is mounted on the belt of the ruler, an outboard ruler strip having an inboard end slidably mounted to an outboard end of the inboard ruler strip, wherein the ruler strips of each ruler assembly are adapted to move downwardly an incremental distance upon the actuation thereof; and a controller connected to the page lifters and the ruler assemblies via an elongated cord for selectively actuating the same.

2. A book supporting system comprising:

a base;

a book support including a rear plate, a pair of downwardly extending stanchions coupled to a bottom edge of the rear plate for mounting on the base, a pair of side faces coupled to side edges of the rear plate and extending forwardly therefrom, a pair of rear braces each having a top end coupled to the rear plate and extending downwardly therefrom and terminating with a pair of feet, a pair of pivot couples mounted on each of the side faces, and a pair of wings each including an inboard planar member having an inboard edge pivotally coupled to the pivot couples of one of the side faces of tile book support, an outboard planar member slidably positioned in the inboard planar member and having a lip extending from a bottom edge of tile outboard planar member;

a lamp assembly including an adjustable arm mounted to tile book support and a lamp mounted to tile adjustable arm for illuminating purposes;

a pair of page lifters each including a housing mounted to the bottom edge of one of the inboard planar members of the book support and having a slot on a top face thereof, a belt mounted in the housing between a pulley and a motor, an arm coupled to the belt and extending upwardly through the slot for sliding therein, and a gripping member mounted to an end of the arm, wherein the gripping member is moved in the slot upon actuation a pair of ruler assemblies each including a belt mounted along an outboard edge of one of the outboard planar members of the book support and connected between a motor and a pulley, an inboard ruler strip having an inboard end hingably coupled to a tab which is mounted on the belt of the ruler assembly, an outboard ruler strip having an inboard end slidably mounted to an outboard end of the inboard ruler strip, wherein the ruler strips of each ruler assembly are adapted to move downwardly an incremental distance upon the actuation of the ruler assembly; and a controller connected to tile page lifters and the ruler assemblies for selectively actuating the same.

3. The book supporting system of claim 2 additionally comprising a pair of vertically oriented cut outs formed in the rear plate with a plurality of laterally extending recesses, a rod positioned in each of the cut outs in coplanar relationship therewith, a supporting disk having a central aperture for slidably receiving one of the rods and a pair of diametrically opposed grooves for being selectively positioned level with one of the laterally extending recesses.

* * * * *